US009981777B1

(12) United States Patent
Thomson et al.

(10) Patent No.: US 9,981,777 B1
(45) Date of Patent: May 29, 2018

(54) BEVERAGE ACCESSORY HANGER

(71) Applicant: Alliance Consumer Products, Inc., Scottsdale, AZ (US)

(72) Inventors: Stephen J. Thomson, Cave Creek, AZ (US); Joseph M. Rahm, Scottsdale, AZ (US)

( * ) Notice: Subject to any disclaimer, the term of this patent is extended or adjusted under 35 U.S.C. 154(b) by 306 days.

(21) Appl. No.: 14/542,541

(22) Filed: Nov. 14, 2014

Related U.S. Application Data

(60) Provisional application No. 61/905,043, filed on Nov. 15, 2013.

(51) Int. Cl.

| | |
|---|---|
| ***B65D 81/32*** | (2006.01) |
| ***B65D 23/14*** | (2006.01) |
| *B65D 5/42* | (2006.01) |
| *B65D 23/12* | (2006.01) |

(52) U.S. Cl.
CPC ..... *B65D 23/14* (2013.01); *B65D 5/4208* (2013.01); *B65D 23/12* (2013.01)

(58) Field of Classification Search
CPC ..... B65D 23/12; B65D 23/14; B65D 5/4208
USPC ..... 220/23.83; 215/390, 399; 40/124.06, 40/310; 206/216, 446; 211/60.1, 73; 493/51, 52, 162; 229/103.2, 117.12
See application file for complete search history.

(56) References Cited

U.S. PATENT DOCUMENTS

| | | | | | |
|---|---|---|---|---|---|
| 3,245,338 | A * | 4/1966 | Korr | B65D 77/2024 | 206/216 |
| 3,797,658 | A * | 3/1974 | Peacock | 206/484 | |
| 4,331,240 | A * | 5/1982 | Vanasse | B65D 5/18 | 206/340 |
| 4,378,831 | A * | 4/1983 | Koltz | G09F 3/04 | 150/147 |
| 4,457,431 | A * | 7/1984 | Lundquist | B65D 5/42 | 229/100 |
| 5,348,156 | A * | 9/1994 | Maroszek | B65D 5/0254 | 206/216 |
| 2010/0102111 | A1* | 4/2010 | Learn | B65D 5/2033 | 229/117.12 |

FOREIGN PATENT DOCUMENTS

| | | | | |
|---|---|---|---|---|
| FR | 2834497 | * | 7/2003 | B65D 23/12 |

* cited by examiner

*Primary Examiner* — J. Gregory Pickett
*Assistant Examiner* — Elizabeth Volz
(74) *Attorney, Agent, or Firm* — Thomas W. Galvani, P.C.; Thomas W. Galvani

(57) ABSTRACT

Packaging for displaying an accessory with a beverage such as a wine bottle includes a compartment having a front, a tab coupled to the compartment for receiving and hanging from the neck of the wine bottle, and a window in the front of the compartment for displaying the accessory within the compartment.

12 Claims, 4 Drawing Sheets

BEVERAGE ACCESSORY HANGER

CROSS-REFERENCE TO RELATED APPLICATIONS

This application claims the benefit of U.S. Provisional Application No. 61/905,043, filed Nov. 15, 2013, which is hereby incorporated by reference.

FIELD OF THE INVENTION

The present invention relates generally to packaging, and more particularly to packaging products for affixing accessories to beverages.

BACKGROUND OF THE INVENTION

Wine is a product that for centuries has stood alone as both a beverage and as a gift. Wines command a price range and gift value that ranges from the very low to the incredibly high. People are always happy to receive wine, like to give wine, and of course, love to drink wine. It is a product that is offered as gift, purchased for personal consumption, sold by wineries to wine lovers, provided by restaurants with meals, grabbed from a hotel mini-bar, and enjoyed by one or several people. In short, wine is available in a myriad of locations and is appropriate in a wide variety of settings.

Traditionally, most wine bottles are closed with a cork and must be opened with a corkscrew. Like wines themselves, corkscrews also range in style and quality from inexpensive waiter corkscrews to very high-end, carbon-fiber two-step levers. Unlike wines, however, corkscrews are not frequently thought of as a gift, despite the fact that wine is often given as a gift. Further, corkscrews are not marketed well. For all but the most sophisticated connoisseur, corkscrews tend to be an afterthought, purchased out of necessity. A way of presenting a corkscrew as a gift, and as a purchase on its own, is needed. Indeed, a way of presenting many wine-related accessories is needed.

SUMMARY OF THE INVENTION

Packaging for presenting an accessory together with a beverage, such as a wine bottle, beer bottle, or other bottle or item, includes a compartment and a tab formed from a continuous sheet of material. The compartment has a front and opposed back, a top and opposed bottom, and opposed sides, defining an interior of the compartment. The tab is coupled to the top and back of the compartment, and has a hole formed therethrough to be slid over the neck of the bottle or item. The tab is coupled to the compartment along a living hinge. A window is formed through the front of the compartment so that the accessory in the interior is displayed.

BRIEF DESCRIPTION OF THE DRAWINGS

Referring to the drawings.

DETAILED DESCRIPTION

Figure 1:
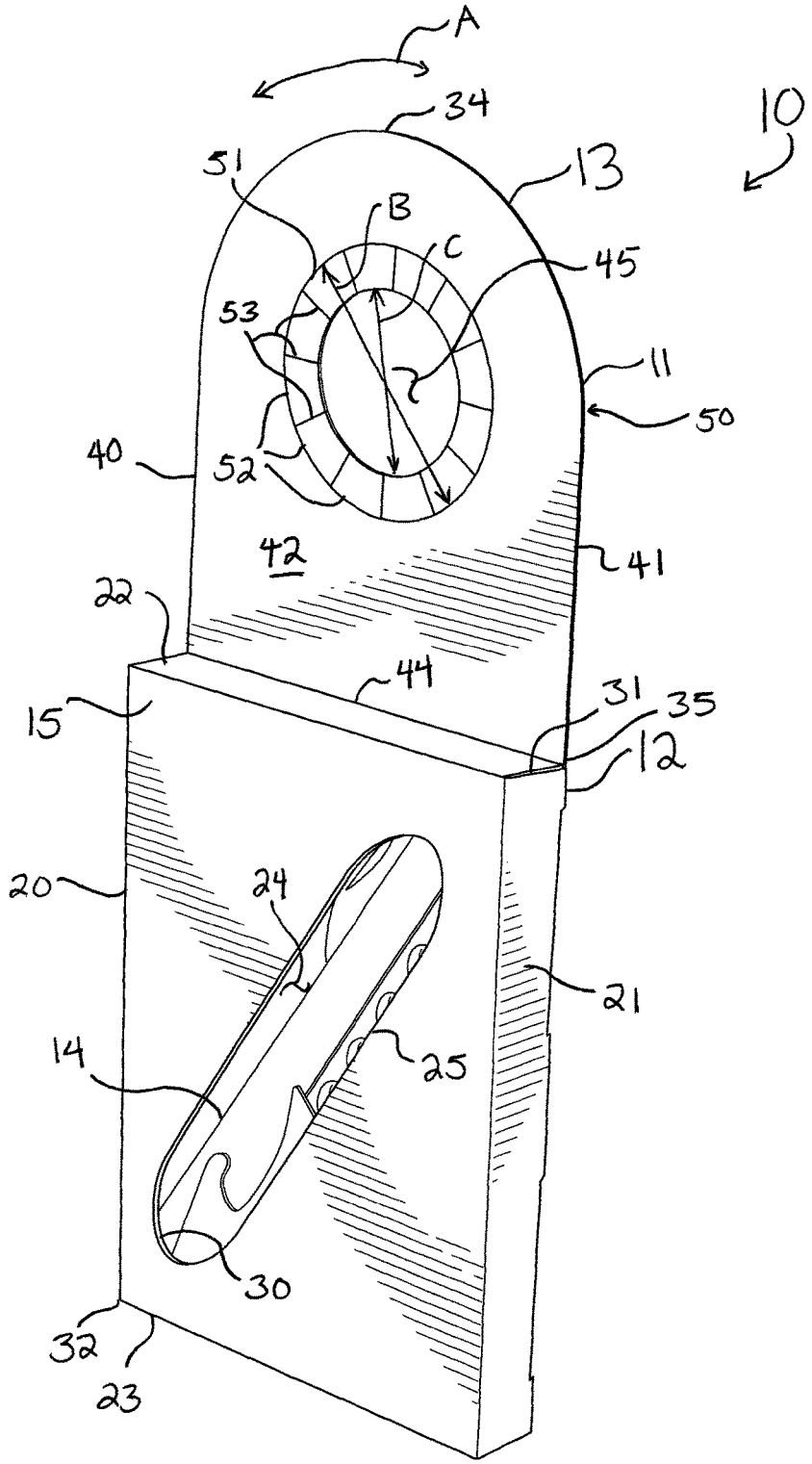
FIG. 1 is a front perspective view of a beverage accessory hanger.
Figure 2:
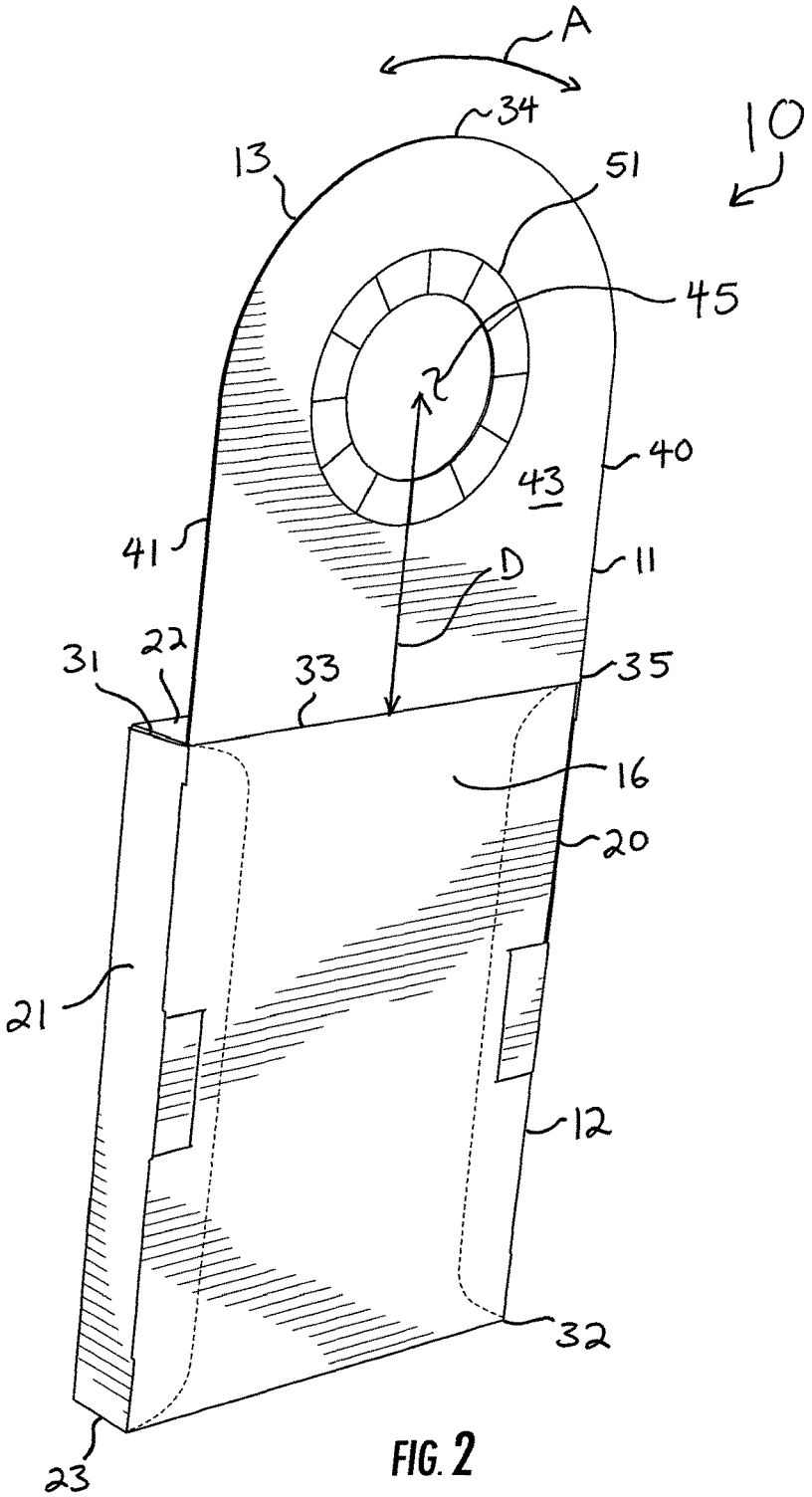
FIG. 2 is a rear perspective view of the beverage accessory hanger of FIG. 1.
Figure 3:
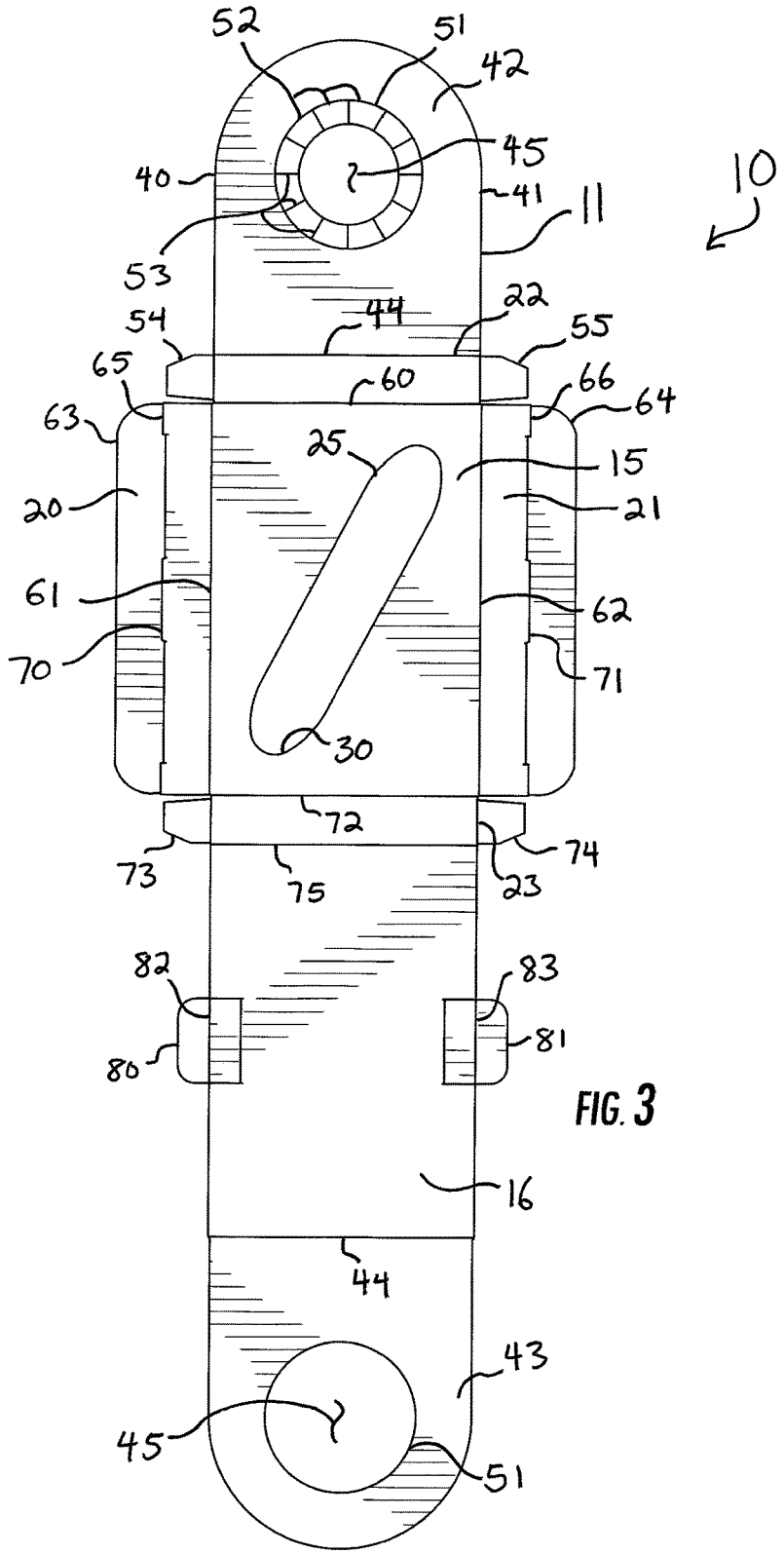
FIG. 3 is a top plan view of a sheet forming the beverage accessory hanger of FIG. 1.

Reference now is made to the drawings, in which the same reference characters are used throughout the different figures to designate the same elements. FIG. 1 illustrates a beverage accessory hanger 10 useful for being attached to beverages having a slender neck and wide body so as to display or package an accessory within the hanger 10 with the beverage. The hanger 10 is packaging formed from a continuous sheet 11 of material, preferably rigid paper, card stock, plastic, or the like. The sheet 11 is cut, bent, folded, shaped, and glued into the form shown in FIGS. 1, 2, and 4. FIG. 3 illustrates the sheet 11 in a laid-flat condition. The hanger 10 is a tamper-proof packaging including a compartment 12 and a tab 13 coupled to the compartment 12 for applying the hanger 10 to the neck of a beverage such as wine bottle. The compartment 12 holds and carries an accessory 14, such as a corkscrew or bottle opener. The hanger 10 is a convenient way to deliver, supply, or present the accessory 14 together with the wine bottle as a tied product, such as a gift package.

The compartment 12 is a hollow box and includes a front 15, an opposed back 16 (shown in FIG. 2), opposed sides 20 and 21, a top 22, and an opposed bottom 23. The compartment 12 has a rectangular prismatic shape; the front 15 and back 16 are broad, flat, and parallel with respect to each other, the sides 20 and 21 are thin, flat, parallel with respect to each other, and transverse with respect to the front 15 and back 16, and the top 22 and bottom 23 are thin, flat, parallel with respect to each other, transverse with respect to the front 15 and back 16, and transverse with respect to the sides 20 and 21. The hanger 10 has a form factor roughly the size and shape of a pack of conventional playing cards.

The compartment 12 bounds and defines an interior 24 also having a rectangular prismatic shape. The front 15 of the compartment 12 has a window 25 formed completely through the front 15 to expose a portion of the interior 24 so that observers can see the interior 24 and the contents of the interior 24, thereby placing the accessory 14 on display. The window 25 has an irregular edge 30 which is cut to correspond and conform closely to the profile of the accessory 14 in the interior 24. As shown in the embodiment in FIG. 1, the edge is generally oval-shaped, having a long axis extending diagonally across the front 15, between two opposed corners 31 and 32. The close conformance of the edge 30 to the profile of the accessory 14 provides a visually-appealing aesthetic to the hanger 10 which allows a prospective purchaser to view the accessory 14 in a unique fashion. Various accessories, or multiple accessories, can be carried in the compartment 12, each with its own profile, and the edge 30 of the window 25 is cut to correspond to the profile of each such accessory 30. A corkscrew is used as a demonstrative example for the accessory 14 throughout the FIGS.

Where the sheet 11 is constructed from paper, card stock, or like materials or combination of materials, the sheet 11 is preferably opaque, so that the only portion of the accessory 14 which is exposed and observable is that which is disposed in the window 25. This provides a further unique viewing aesthetic, improving the marketability of the hanger 10. Where the sheet 11 is constructed from plastic or like materials or combination of materials, the sheet 11 may be opaque, but is preferably translucent or transparent, allowing the entire accessory 14 to be viewed and both the front and back 15 and 16 to be viewed at the same time, which allows for the use of unique art arrangements on the packaging.

The tab 13 projects upwardly from the compartment 12 at the top 12 and the back 16. The tab 13 is a contiguous extension of the back 16, with only a fold 33 delineating the tab 13 from the back 16, as shown in FIG. 2. The tab 13 has a top 34, an opposed bottom 35, and opposed sides 40 and 41. The sides 40 and 41 are straight and parallel with respect to each other, and are aligned with and contiguous to the sides 20 and 21 of the compartment 12, respectively, so that the tab 13 is equal in width to the compartment 12. The tab 13 has a two-layer construction including a front panel 42 and a back panel 43. Referring briefly to the laid-flat condition of the sheet 11 shown in FIG. 3, the front panel 42 is entirely opposed from the back panel 42 on the sheet 11 when the sheet 11 is in the laid-flat condition. The front panel 42 extends integrally from the top 22 and front 15 of the compartment 12, and the back panel 42 extends integrally from the back 16 of the compartment 12. The front and back panels 42 and 43 are securely adhered together, such as with tape, glue, or some other similar permanent adhesive during assembly of the hanger 10. The front and back panels 42 and 43, adhered together, provide rigidity to the tab 13 so that the tab 13 resists bending or flexing in any direction along its height and width and remains rigid.

A living hinge 44 is formed between the tab 13 and the top 22 of the compartment 12. The living hinge 44 is formed at the joinder of the front and back panels 42 and 43 at the bottom 35 of the tab 13 and extends continuously between the sides 20 and 21 of the compartment 12 and between the sides 40 and 41 of the tab 13. The living hinge 44 binds the tab 13 to the compartment 12 and allows the tab 13 to flex forwardly and rearwardly, as illustrated by arcuate line A in FIGS. 1 and 2. The living hinge 44 flexes in response to torsional force applied across the hanger 10 to prevent the compartment 12 or the tab 13 from flexing, bending, or deforming in response.

The tab 13 has a hole 23 formed through the tab 13. In a preferred embodiment, the hole 45 is circular. The hole 45 is located in an upper portion 24 of the tab 13. The hole 45 is defined, by a continuous annular edge 51 bounding the hole 45. As seen in FIG. 3, the hole 45 is formed through both the front and back panels 42 and 43 of the sheet 11, and the edge 51 is defined cooperatively between the front and back panels 42 and 43. The front panel 42 has a plurality of radially inwardly-directed fingers 52 extending into the hole from the front panel 42, each separated by slits 53 allowing the fingers to flex into and out of the plane of the hole 45 independently. Returning to FIG. 1, the hole 45 has a diameter B, and the fingers define a smaller diameter C within the hole 45. As shown in FIG. 2, the geometric center of the hole 45 is located a distance D away from the top 22 of the compartment 12.

The accessory 14 is carried within the compartment 12. The compartment 12 is sized to appropriately accommodate the accessory 14. In the embodiment shown in FIGS. 1-4, the compartment 12 has a relatively thin profile commensurate with the relative thinness of a conventional corkscrew. Where the accessory 14 is some other item, such as a wine stopper, the size and proportions of the compartment 12 are appropriately different. The accessory 14 is retained between the two corners 31 and 32, formed between the top 22 and side 21 and between the bottom 23 and side 20, respectively. The accessory 14 is inserted into the compartment 12 before the compartment 12 is fully assembled and closed; upon closing the compartment 12, the object is retained and held within the compartment 12 and prevented from movement up, down, and sideways by the compartment 12, thus being held just behind the window 25 so that the object 22 is visible through the window 25.

FIG. 3 illustrates the sheet 11 in the laid-flat condition. The sheet 11 provides a convenient template for forming the hanger 10. The sheet 11 is die cut, bent, and then glued into the shape of the hanger 10 as shown in the other FIGS. This laid-flat condition is a collapsed condition of the hanger 10 which is useful for storing and shipping the hanger 10 before assembly. Once assembled into the form of the hanger 10 shown in FIGS. 1, 2, and 4, the hanger 10 cannot be returned to the laid-flat condition of the sheet 11 shown in FIG. 3 without damaging at least part of the hanger 10.

Because the sheet 11 is continuous, living hinges formed from folds in the sheet 11 couple most of the parts of the sheet 11. Each of the living hinges is flexible and capable of cyclical and repeated flexing without breaking or tearing. Starting from the top of FIG. 1 and moving downward, the front panel 42 is shown. The front panel is coupled to the top 22 along a fold that, together with a fold between the back 16 and the back panel 43, forms the living hinge 44. Two flaps 54 and 55 extend from living hinges off opposed sides of the top 22. The top 22 is coupled along a living hinge 60 to the front 15. The sides 40 and 41 extend off the front 15 at opposed living hinges 61 and 62. Full-length tabs 63 and 64 are coupled to the sides 20 and 21, respectively, along living hinges 65 and 66, respectively. A slot is formed in each of the living hinges 65 and 66; slot 70 is formed in a generally intermediate portion of the living hinge 65, and slot 71 is formed in a generally intermediate portion of the living hinge 66. A living hinge 72 is formed between the front 15 and the bottom 23. Two flaps 73 and 74 extend from living hinges off opposed sides of the bottom 23. The back 16 is coupled to the bottom 23 along a living hinge 75. Two tabs 80 and 81 extend laterally from living hinges 82 and 83, respectively, on opposed sides of the back 16. The tabs 80 and 81 are formed at generally intermediate positions along the opposed sides of the back 16 and correspond in size and location to the slots 70 and 71, respectively, formed in the living hinges 65 and 66 joining the front 15 to the sides 40 and 41, respectively. When assembled, the tabs 80 and 81 fit and are secured into the slots 70 and 71; they are thus characterized as "lock tabs." The flaps 54, 55, 73, and 74 are each tucked under the sides 40 and 41 when the hanger 10 is assembled. Lastly, the back panel 43 is coupled to the back 16 along a fold that, together with the fold between the front 15 and the front panel 42 of the tab 11, forms the living hinge 44.

To assemble the hanger 10 from the condition shown in FIG. 3 to the condition shown in FIGS. 1 and 2, the sheet 11 is bent along the living hinges. The front 15 and back 16 are brought together so that they are parallel and aligned, and spaced apart by the bottom 23. The flaps 54, 55, 73, and 74 are folded and tucked at ninety-degree angles to the top and bottom 22 and 23. The sides 40 and 41 are then bent and the tabs 63 and 64 are tucked behind the back 16, into the interior 24. The tabs 80 and 81 are then folded into the slots 70 and 71, respectively, and tape is preferably applied over the slots 70 and 71 with the tabs 80 and 81 held therein. The accessory 14 is dropped into the interior 24 through the open top and is aligned between the corners 31 and 32, and the top 22 is then folded so that the front panel 42 is aligned with, parallel to, and proximate to the back panel 43. An adhesive is applied between the front and back panels 42 and 43, and the front and back panels 42 and 43 are pressed and adhered together. In this way, the hanger 10 is assembled in the configuration shown in FIGS. 1 and 2.

Figure 4:
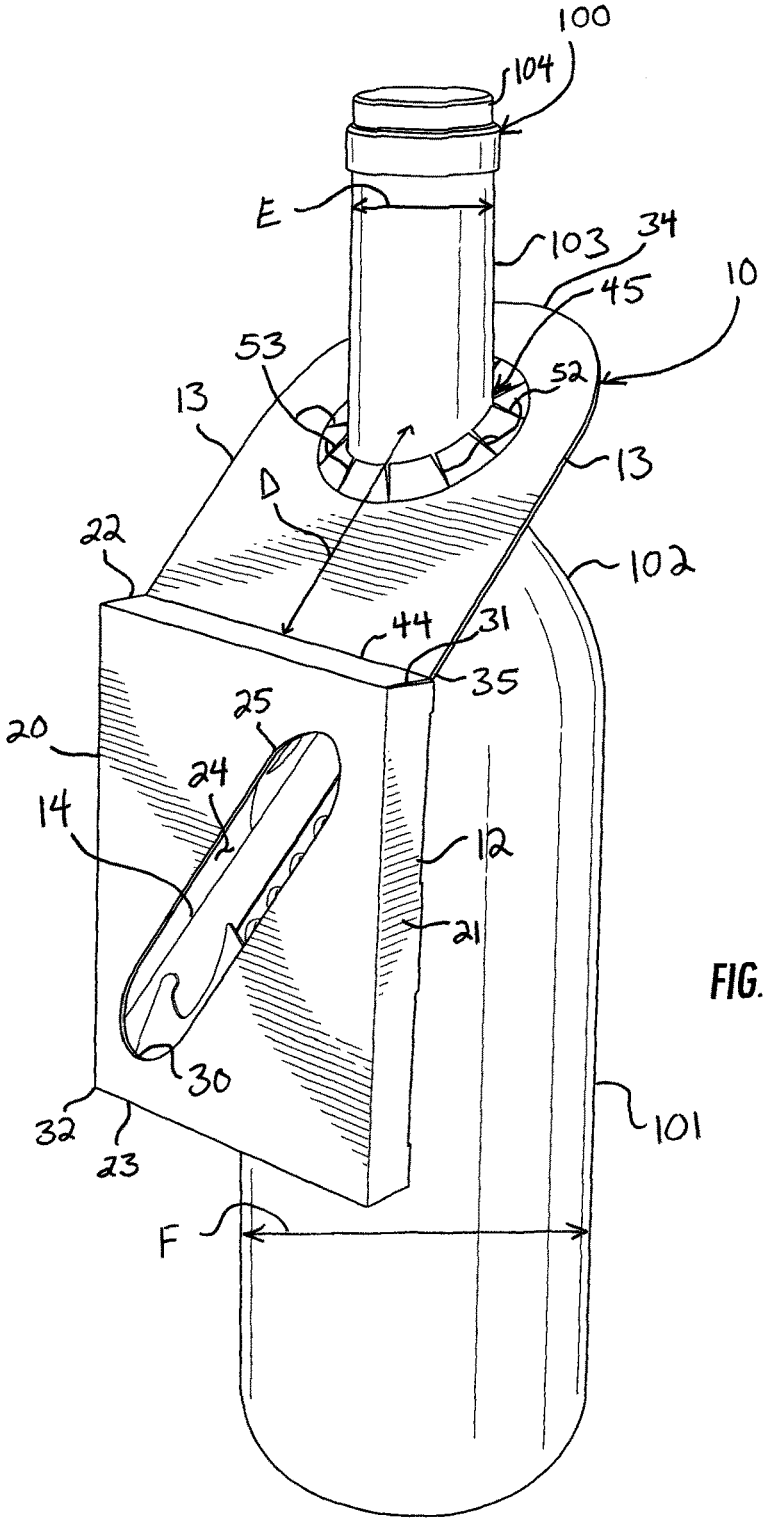
FIG. 4 is a front perspective view of the beverage accessory hanger of FIG. 1 applied to a bottle.

Turning now to FIG. 4, the hanger 10 is packaging applied to a bottle 100. The bottle 100 has a conventional tapered cylindrical shape with a main body 101 at the bottom, and a shoulder 102 above the body 51 which transitions into a slender neck 103 terminating in a top 104. The hanger 10 is applied to the bottle 100 by placing the hole 45 over the top 104 of the bottle 100 with the compartment 12 depending from the tab 13. The hanger 10 is slid and lowered down over the neck 103 until the tab 13 is against the shoulder 102. When the hanger 10 is placed over the top 104 and the neck 103, the bottle 100 causes the fingers 52 to flex upwardly out of the plane of the hole 45. With the fingers 52 flared upwardly, the fingers 52 resist movement of the hanger 10 upward along the neck 103; upward movement will urge the fingers 52 to move in opposition to their arrangement against the neck 103, and the fingers 52 will produce a resisting force in response.

While the neck 103 has a width E which is smaller than the diameter D of the hole 105, the body 101 has a width F which is larger than the diameter D of the hole 45, so that shoulder 102 has, at some point between the body 101 and neck 103, a width commensurate to the diameter D of the hole 45. The hanger 10, with an accessory 14 applied to the interior 31, has a center of gravity generally corresponding to the center of gravity of the accessory 14, because the accessory 14 is much heavier than the hanger 10. Therefore, the center of gravity of the hanger 10 will be in the interior 24, causing the compartment 12 to depend from the tab 13 and the tab 13 to rest transverse against the shoulder 102 of the bottle 100. The rigidity of the tab 13 provided by the two-layer construction of the tab 13 prevents the tab 13 from bending or deforming under the weight of the compartment 12 laden with the accessory 14.

As shown earlier in FIG. 2, the hole 45 is disposed a distance D away from the top 22 of the compartment 12. The distance D is greater than the diameter E of the neck 103 of the bottle 100, but smaller than the diameter F of the body 101 of the bottle 100. The distance D is greater than half the diameter F of the body 101 of the bottle 100, and is greater than half the diameter C of the hole 45 (shown in FIG. 1). Most bottles 100 are standarized in size and have a typical diameter E of the neck 103. The compartment 12 hangs downwardly from the tab 13, biasing the tab 13 outward, and the hole 45 fitted around the neck 103 of the bottle 100 will prevent the tab 13 from moving, so that the compartment 12 hangs generally vertically, with substantially the entire height of the back 16 of the compartment 12 resting against the body 101 of the bottle 100.

In operation, the hanger 10 is useful as complemental packaging for a beverage container, such as a wine bottle. The hanger 10 allows a corkscrew or bottle opener or other accessory to be displayed together with the bottle it is meant to open. A combination such as this is an attractive way to advertise or sell alcohol in gift shops, airport stores, resort mini-bars, and other areas where a single bottle of wine may be purchased.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. Packaging comprising:

an integral compartment defining a rigid box, the compartment having a front panel, an opposed back panel, a closed top panel fixed between the front and back panels, an opposed closed bottom panel, opposed sides, and an enclosed interior space bound continuously by the front, back, top, bottom panels and sides;

a tab monolithically and directly coupled to the compartment, the tab configured to receive a slender object, wherein the tab comprises a front panel extending integrally from the top panel of the compartment and a back panel extending integrally from the back panel of the compartment;

a living hinge couples the compartment to the tab for flexible movement with respect to the tab;

a hole formed through the compartment defining a window in the front panel of the compartment for displaying contents within the compartment, wherein the window is sized and shaped to conform closely to a profile of a wine opener;

a free condition of the packaging; and an applied condition of the packaging in which the compartment flexibly depends from the tab about the living hinge;

wherein the packaging is formed entirely from a single, continuous sheet of material, and the front and back panels of the tab are separate panels secured together coextensively to define the tab as a two-layer contiguous extension of the top and back panels of the compartment.

2. The packaging of claim 1, wherein the window extends diagonally across the front panel of the compartment between opposed corners of the compartment.

3. The packaging of claim 1, wherein the tab extends from the back and top panels of the compartment.

4. The packaging of claim 1, wherein the living hinge is formed between the compartment and the tab.

5. The packaging of claim 1, further comprising a hole formed through the tab.

6. The packaging of claim 5, further comprising radially inwardly-directed fingers extending into the hole from the tab.

7. Packaging comprising:

an integral compartment defining a rigid box, the compartment having a front panel and opposed back panel, opposed sides, a closed top panel and opposed closed bottom panel, and an enclosed interior space bound continuously by the front, back, top, bottom panels and sides;

a tab monolithically and directly coupled to the compartment comprising opposed free ends of the opposed front and back panels, wherein the tab comprises a front panel extending integrally from the top panel of the compartment and a back panel extending from the back panel of the compartment;

a living hinge couples the compartment to the tab for flexible movement with respect to the tab;

a hole formed through the tab and disposed away from the compartment, the hole configured to receive a neck of a wine bottle;

a hole formed through the compartment defining a window in the front of the compartment for displaying contents within the compartment;

a free condition of the packaging; and an applied condition of the packaging in which the compartment flexibly depends from the tab about the living hinge;

wherein the packaging is formed entirely from a single, continuous sheet of material, and the front and back panels of the tab are separate panels secured together coextensively to define the tab as a two-layer contiguous extension of the front and back panels of the compartment.

8. The packaging of claim 7, wherein the window extends diagonally across the front panel of the compartment between opposed corners of the compartment.

9. The packaging of claim 7, wherein the window is shaped to conform closely to a profile of a wine opener.

10. The packaging of claim 7 wherein:

the hole has a diameter;

the tab extends from the top and back panels of the compartment; and the hole is disposed away from the top panel of the compartment by at least half the diameter of the hole.

11. The packaging of claim 7, wherein the living hinge is formed between the compartment and the tab.

12. The packaging of claim 7, further comprising radially inwardly-directed fingers extending into the hole from the tab.

* * * * *